US005588704A

United States Patent [19]

Harza

[11] Patent Number: 5,588,704

[45] Date of Patent: Dec. 31, 1996

[54] ERGONOMIC ANTIFATIGUE SEATING DEVICE AND METHOD

[76] Inventor: Richard D. Harza, 655 Sheridan Rd., Winnetka, Ill. 60093

[21] Appl. No.: 632,770

[22] Filed: Apr. 15, 1996

Related U.S. Application Data

[63] Continuation of Ser. No. 308,621, Sep. 19, 1994, abandoned, which is a continuation of Ser. No. 929,964, Aug. 13, 1992, abandoned.

[51] Int. Cl.[6] ..... A61H 1/00

[52] U.S. Cl. ..... 297/314; 297/330; 601/91; 601/98

[58] Field of Search ..... 297/313, 314, 297/337, DIG. 10, 330, 344.23; 601/1, 84, 87, 90, 91, 93, 98, 101, 26; 248/398, 651, 652, 660

[56] References Cited

U.S. PATENT DOCUMENTS

| | | | |
|---|---|---|---|
| 2,719,571 | 10/1955 | Taylor | 297/314 |
| 2,731,074 | 1/1956 | Steinle | 297/314 |
| 2,944,591 | 7/1960 | Morrill, Jr. | 297/337 |
| 3,148,391 | 9/1964 | Whitney | 5/348 |
| 3,191,594 | 6/1965 | Bagnell | 128/24 |
| 3,270,440 | 9/1966 | Radosevic, Jr. | 35/12 |
| 3,477,071 | 11/1969 | Emerson | 5/61 |
| 3,492,988 | 2/1970 | De Mare | 128/33 |
| 3,580,634 | 5/1971 | Bock | 297/313 |
| 3,613,671 | 10/1971 | Poor et al. | 128/24 R |
| 3,641,995 | 2/1972 | Brandt | 297/330 |
| 3,659,897 | 5/1972 | Wright | 297/DIG. 10 |
| 3,667,453 | 6/1972 | Schenck et al. | 128/24 R |
| 3,824,991 | 7/1974 | Whitaker | 601/26 |
| 3,867,732 | 2/1975 | Morrell | 5/349 |
| 4,444,430 | 4/1984 | Yoshida et al. | 297/284 |
| 4,515,337 | 5/1985 | Torras | 297/314 |
| 4,552,402 | 11/1985 | Huber et al. | 297/284 |
| 4,552,404 | 11/1985 | Congleton | 297/330 |
| 4,570,676 | 2/1986 | Nishio et al. | 137/870 |
| 4,592,588 | 6/1986 | Isono et al. | 297/284 |
| 4,612,917 | 9/1986 | Kesler | 601/101 |
| 4,655,505 | 4/1987 | Kashiwamura et al. | 297/284 |
| 4,688,851 | 8/1987 | Whiteford | 297/DIG. 10 |
| 4,722,550 | 2/1988 | Imaoka et al. | 280/727 |
| 4,796,948 | 1/1989 | Paul et al. | 297/284 |
| 4,826,247 | 5/1989 | McGrady et al. | 297/314 |
| 4,832,407 | 5/1989 | Serber | 297/313 |
| 4,833,614 | 5/1989 | Saitoh et al. | 364/424.05 |
| 4,840,425 | 6/1989 | Noble | 297/284 |
| 4,860,733 | 8/1989 | Parker, Jr. | 297/330 |
| 4,890,886 | 1/1990 | Opsvik | 297/313 |
| 4,915,124 | 4/1990 | Sember, III | 137/223 |
| 5,022,385 | 6/1991 | Harza | 128/33 |
| 5,022,708 | 6/1991 | Nordella et al. | 297/330 |
| 5,035,466 | 7/1991 | Mathews | 297/337 |
| 5,054,739 | 10/1991 | Wallin | 297/314 |
| 5,082,327 | 1/1992 | Crisp | 297/DIG. 10 |
| 5,113,851 | 5/1992 | Gamba | 297/330 |
| 5,116,100 | 5/1992 | Iversen | 297/313 |
| 5,362,302 | 11/1994 | Jensen et al. | 601/24 |

FOREIGN PATENT DOCUMENTS

| | | | |
|---|---|---|---|
| 1457227 | 12/1976 | United Kingdom | 297/314 |

*Primary Examiner*—Amy B. Vanatta
*Attorney, Agent, or Firm*—Brinks, Hofer, Gilson & Lione

[57] ABSTRACT

A method and apparatus is disclosed for periodically and rhythmically lifting one hip of a seated person and then the other, thereby simulating the muscle stimulation and relaxation imparted to a person by walking. A rotatable support panel is provided for alternately lifting and moving backward and forward each hip of a seated person.

6 Claims, 5 Drawing Sheets

ERGONOMIC ANTIFATIGUE SEATING DEVICE AND METHOD

This application is a continuation, of application Ser. No. 08/308,621, filed Sep. 19, 1994 now abandoned, which is continuation of application Ser. No. 07/929,964. filed Aug. 13, 1992, now abandoned.

FIELD OF THE INVENTION

This invention relates in general to an ergonomic antifatigue seating device and method. More particularly, this invention relates to a seating device and method for simulating rhythmic and periodic walking motions in the lower midsection of a seated person.

BACKGROUND OF THE INVENTION

Although it is less publicized than other forms of exercise, walking is one of mankind's oldest and most universal methods of muscle relaxation and stimulation. In this age of high-tech exercise equipment and low impact aerobics, many have forgotten the fact that we can achieve beneficial muscle and spinal stimulation from a simple stroll around the block.

An explanation of the dynamics of walking illustrates the various muscle and spinal movements that take place. The lower spine rests on the pelvis whereby pelvic movement controls lower spine movement. Consider the three main forces that operate on the pelvis of an upright standing person. The right and left thigh bone each push up on opposite ends of the pelvis, while the centrally located spine pushes it down. These three forces balance each other out, and the pelvis remains horizontal in the transverse direction. When a person begins to walk, weight is shifted to one foot, for example the right foot, and the left foot is lifted off the ground. At this instant, the three forces are no longer in balance. The right thigh bone pushes up on the pelvis; the spine pushes down; and the weight of the raised left leg pulls down. As a result, the pelvis tilts down on the left side and the lower spine tilts out in the direction of the left side. This spine tilt would produce a side to side motion of the upper body when walking. However, this normally does not happen because as soon as the lower spine starts its leftward tilt, the upper spine spontaneously flexes or curves itself to the right. This effectively cancels the tendency of the upper body to move to the left. A similar action occurs as the person next steps with the left foot. Thus, a stable upper body position is maintained while walking.

The above-described lateral flexing of the spine occurs during each step in the walking process and has a great effect on the health, blood circulation, and proper functioning of the organs (including digestive) located in the lower midsection. Since a normal person may take from 1000 to 10,000 steps each day, it can be seen that lateral flexing is the dominant type of repetitive movement for the spine.

In addition to the above described lateral flexing of the spine when walking, the spine also twists or rotates back and forth in a repetitive fashion. This action is necessary because of the fact that in walking first one hip and then the other will move forward of the opposite hip, yet the head instinctively remains relatively stationary. The repeated twisting of the spine compensates for the hip and pelvis rotation and thus permits the head to remain stationary and free from rotation.

The walking motions in the pelvis described above could also be described as a "wobble motion." For purposes of this disclosure, wobble motion occurs when an object tilts from side to side moving about a fixed horizontal axis, and at the same time it rotates back and forth about a fixed vertical axis. Also for purposes of this disclosure, a "wobble motion pattern" is when an object is subject to a continuing, rhythmic wobble motion. Thus, when a person is walking, the pelvis moves in a wobble motion pattern. The lower spine is closely connected to the pelvis by the sacrum which also experiences wobble motion.

Prior support devices have been proposed for providing general movement to the user. Examples of such devices include the patents to Noble, U.S. Pat. No. 4,840,425, and Morrell, U.S. Pat. No. 3,867,732. Noble discloses a seat having inflatable portions or sections 60, 62 and 64, 66 defined within the seat bottom and seat back for inflation/deflation. The Noble patent makes no distinction between the left and right sides. Morrell discloses a system similar to Noble which provides for automatic cycling. The Morrell patent also makes no distinction between the left and right sides.

Additional support devices are disclosed in the following U.S. Pat. Nos.

3,148,391

3,270,440

3,477,071

3,492,988

3,613,671

4,444,430

4,552,402

4,570,676

4,592,588

4,655,505

4,722,550

4,796,948

4,833,614

4,915,124

The present applicant was awarded U.S. Pat. No. 5,022,385 ("'385 patent") covering an ergonomic antifatigue seating device and method. The '385 patent generally discloses an antifatigue seating device comprising a pair of inflatable compartments, each positioned under one hip of a seated person. Inflation means periodically inflates one compartment and then the other, thereby periodically raising one hip and then the other to simulate the motion imparted to the lower midsection when a person is walking. In an alternative embodiment, an additional pair of inflatable compartments are provided, with each compartment being positioned behind one hip of the seated person. Inflation means periodically inflates one compartment and then the other, thereby periodically pushing forward one hip and then the other. Inflation of the back compartments may be coordinated with the inflation sequence of the seat compartments. Thus, the '385 patent discloses a seating device that transfers motion to a seated person similar to the motion transferred to the lower midsection when a person is walking. In an additional alternative embodiment, the same motions are produced by mechanically driven compartments.

The present invention is also an ergonomic antifatigue seating device and method. It is an object of this invention to provide an ergonomic antifatigue seating device and method in which a wobble motion pattern is induced in the central body area of a seated person.

It is a feature of the device and method of this invention to provide variable motion to the lower midsection of a user by alternately lifting each of the user's hips.

It is a further feature of this invention to provide wobble motion to the lower midsection of a user by alternately lifting and rotating each of the user's hips. Thus, it is an advantage of this invention that a user can perform a sedentary task and, at the same time, achieve some of the benefits normally attainable through walking. Such tasks may include operating a motor vehicle, working in an office, or any other activity that involves sitting.

SUMMARY OF THE INVENTION

To achieve the foregoing objects, features and advantages, the improved ergonomic antifatigue seating device of the present invention comprises at least one support surface for transferring motion to both hips of a person seated on the device. Motor means imparts a wobble motion pattern to the support surface, thereby periodically moving one hip and then the other hip of the seated person to simulate the motion imparted to the lower midsection when a person is walking.

BRIEF DESCRIPTION OF THE DRAWINGS

A greater appreciation of the objects, features and advantages may be obtained from the following detailed description taken in conjunction with the drawings wherein.

DETAILED DESCRIPTION OF TEE PREFERRED EMBODIMENT

Figure 1:
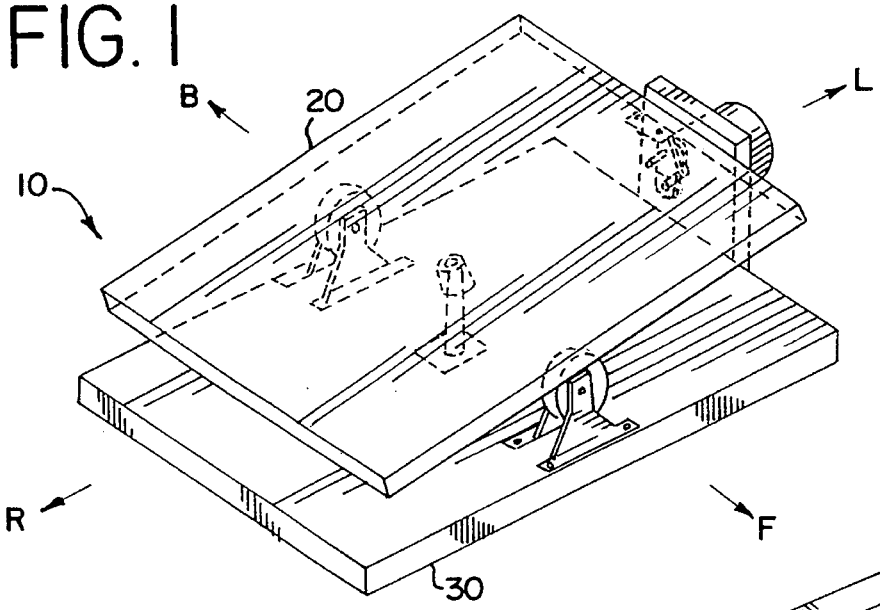
FIG. 1 illustrates one embodiment of the seating device of the present invention.

FIG. 1 illustrates a seating device 10 embodying the method and apparatus of the present invention. The seating device 10 generally comprises a top support panel 20 and a bottom support panel 30. The forward, back, left and right sides of the seating device 10 are indicated by the capital letters F, B, L and R. A motor and reduction gear box 40 impart rotational movement to the left side L of the top panel 20 via a crank pin 44 (shown in FIGS. 2*a* and 2*b*), a crank arm 48 and a crank pin socket plate 52. The centers of the top panel 20 and bottom panel 30 are maintained in a relatively stable position with respect to one another by a center pin 66.

As the motor 40 rotates the crank arm 48 and the crank pin 44 the top panel 20 is taken through a wobbling motion which lifts and moves forward each hip of a person seated on the top panel 20. This wobbling motion is, in effect, a rocking and twisting motion that simulates the motion imparted to the hips and lower midsection of a walking person.

Figure 2B:
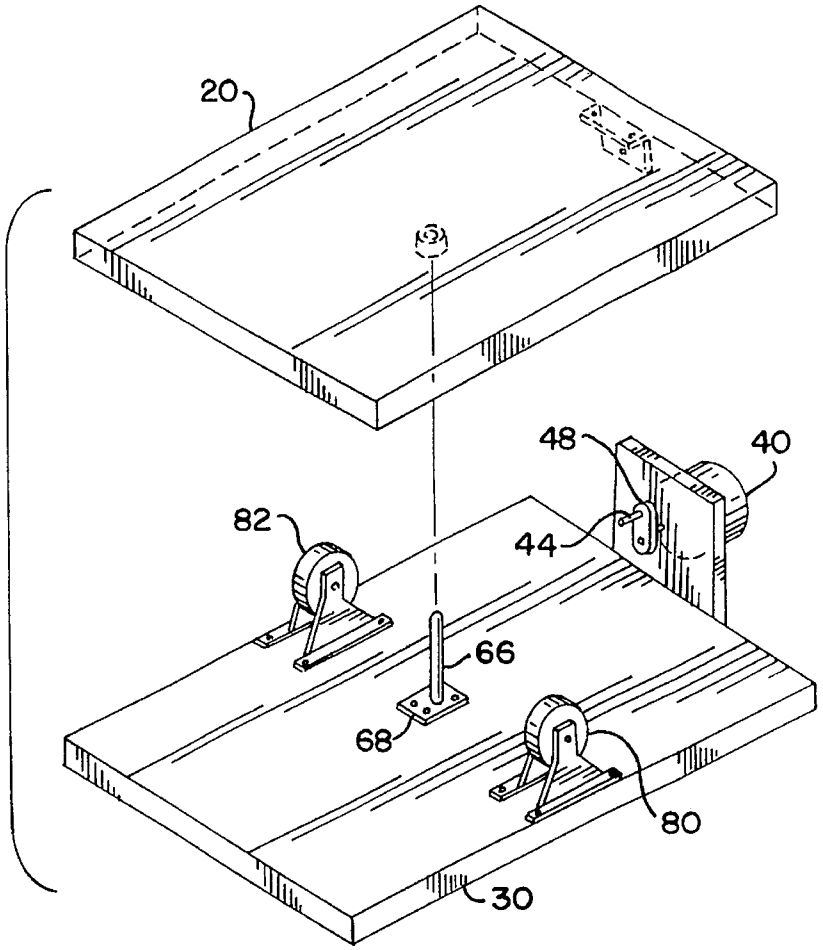
FIG. 2*a* and 2*b* illustrate exploded views of the seating device of FIG. 1.
Figure 2A:
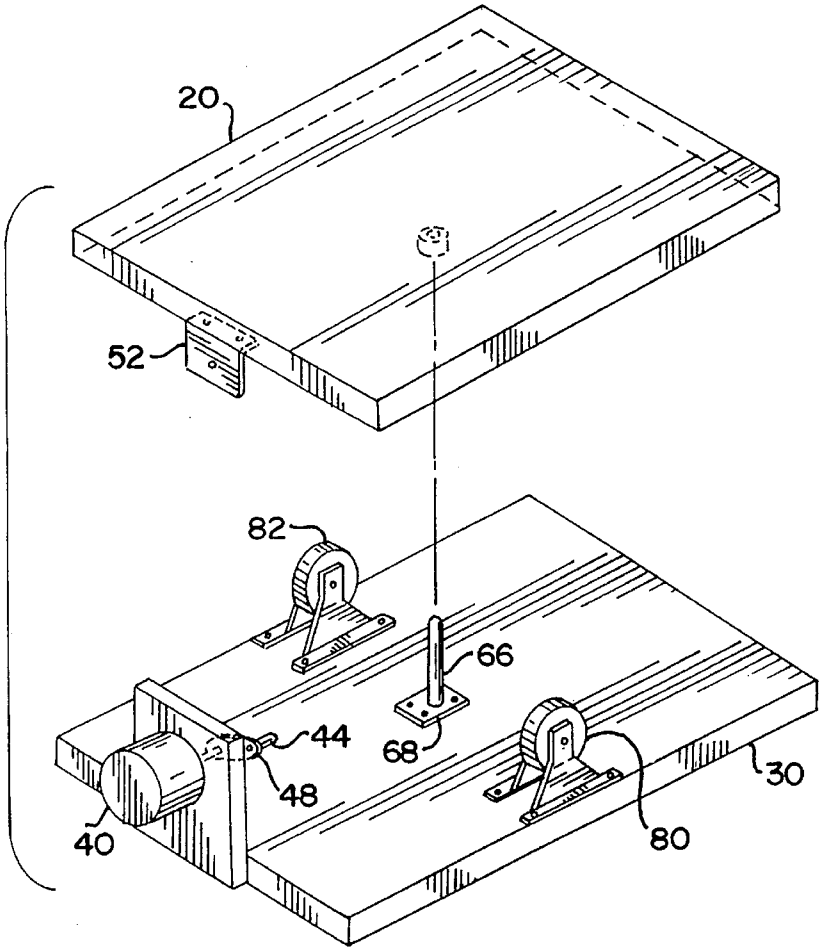
Figure 6:
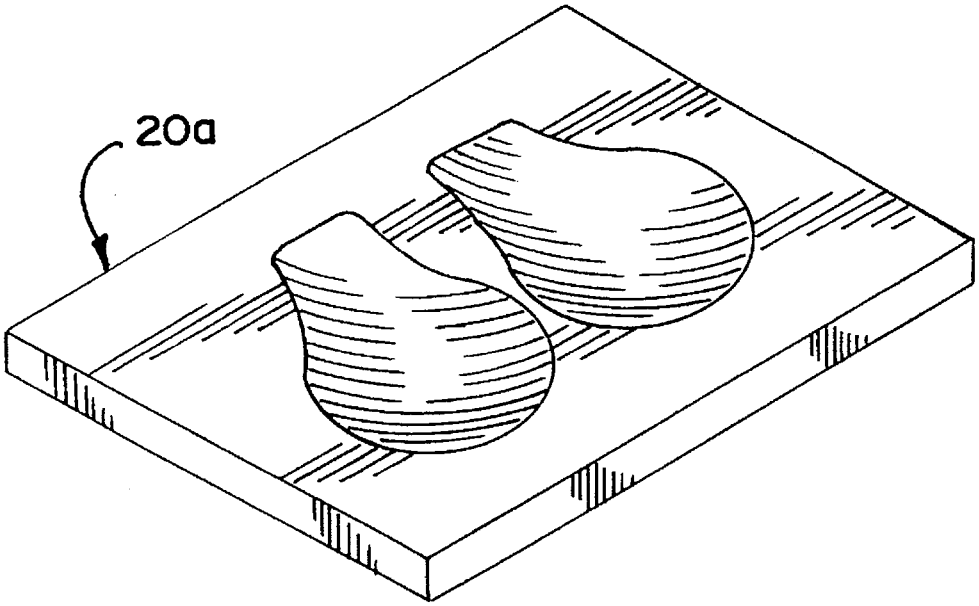
FIG. 6 illustrates a contoured top panel which may be used in the seating device of FIG. 1.

FIGS. 2*a* and 2*b* are exploded views of the seating device 10. The top panel 20 and bottom panel 30 are substantially planar surfaces, preferably made from a strong yet light-weight material such as wood or plastic. Alternatively, as shown in FIG. 6, the top panel may contoured to fit the human buttocks and hips. The motor 40 may be secured to the bottom panel 30 in any suitable manner such as a brace (not shown). The motor 40 can be any motor of sufficient power to move a seated person through the prescribed motion. A suitable motor is manufactured by a company known as "Thoorst" which advertises a place of business in Princeton, Ind. For the disclosed embodiment, the particular Thoorst motor is Model PA, rated at 4 RPM, 115 volts, 60 hertz and 7½ watts. The center of the top panel 20 is maintained in a relatively stable position with respect to the center of the bottom panel 30. This is accomplished by the center pin 66, one end of which rests movably inside an indentation in the top panel 20. The other end of the center pin 66 is secured to the bottom panel 30 via a metal plate 68. The center pin 66 combines with the lateral component of the top panel's rotational motion (left side) to impart a wobbling motion to the top panel 20. This wobbling motion alternately moves the left and right sides of the top panel 20 forward and backward as the left side L of the panel 20 is rotated.

A pair of rollers 80, 82 are secured to the bottom panel 30. The rollers 80, 82 act as a fulcrum and limit the vertical movement of the front (F) and back (B) ends of the top panel 20. The rollers 80, 82 also facilitate the back and forth rotational movements of the top panel 20 (best shown in FIGS. 5*a-c*). Alternatively, the rollers 80, 82 may be secured to the top panel 20.

Figure 3:
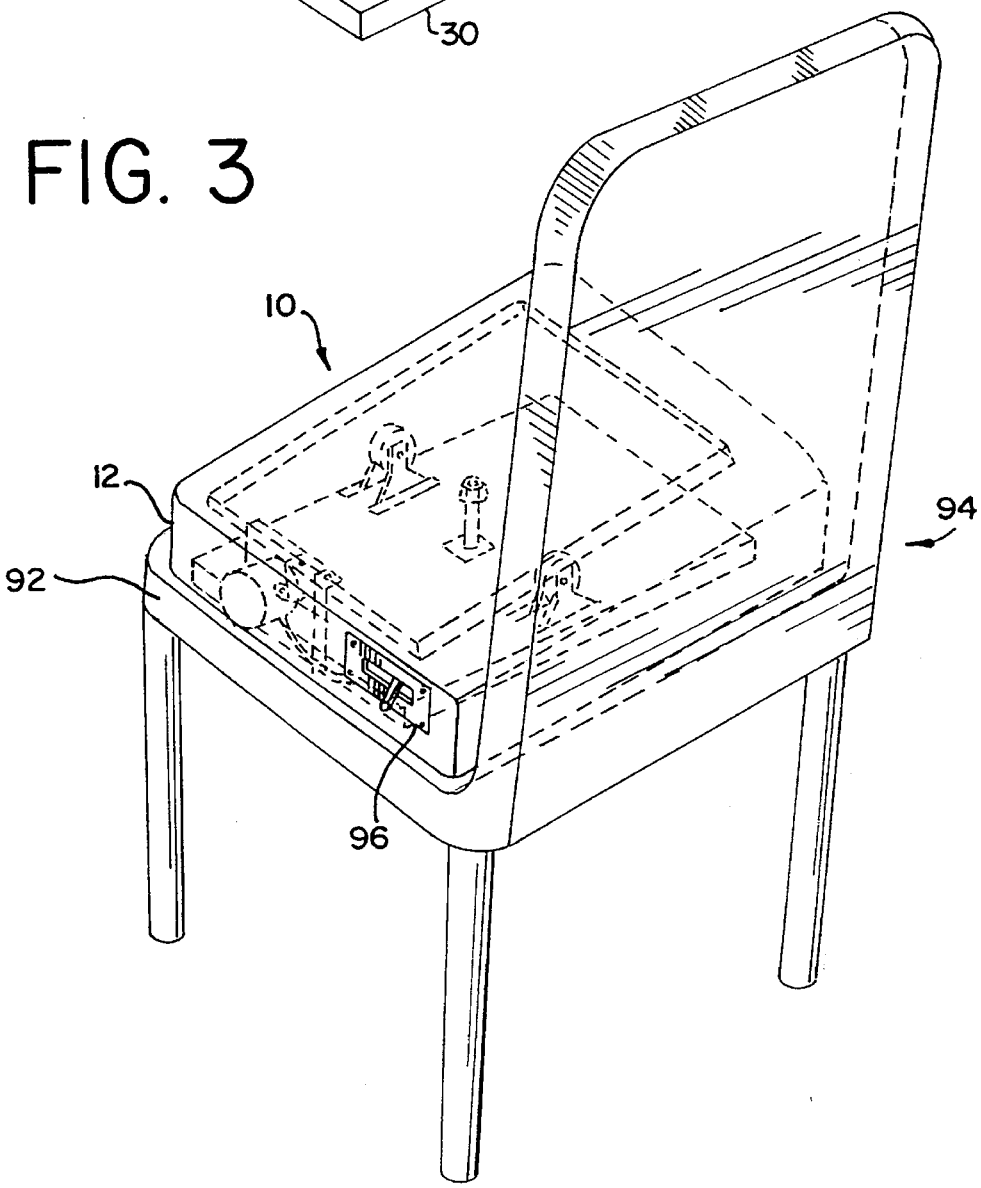
FIG. 3 illustrates the seating device of FIG. 1 and a chair.

Turning now to FIG. 3, the seating device 10 is shown inside a housing 12 which rests on the seat section 92 of a chair 94. A control panel 96 may be attached outside the housing 12 and connected to the motor 40 to allow the user to control the rotational speed of the motor 40. The wobble motion of the panel 20 is imparted to the user via a cushion or other intermediate material (not shown) in the housing 12. The cushion must be sufficiently supple to transfer the motion of the top panel 20 to a user seated on the seat section 92. The panel 20 may also contact the user directly.

Figure 4C:
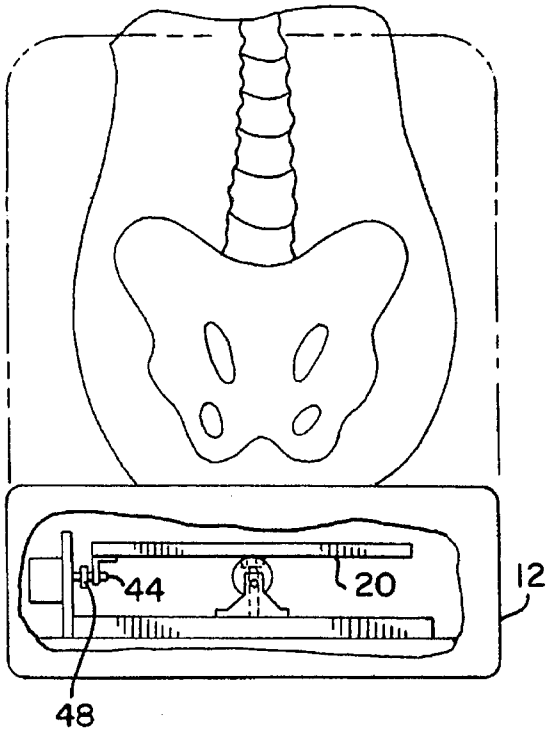
FIGS. 4*a*–4*c* illustrate a cross-section of the seating device of FIG. 3. A user is shown seated on the seating device as it goes through one cycle.
Figure 4B:
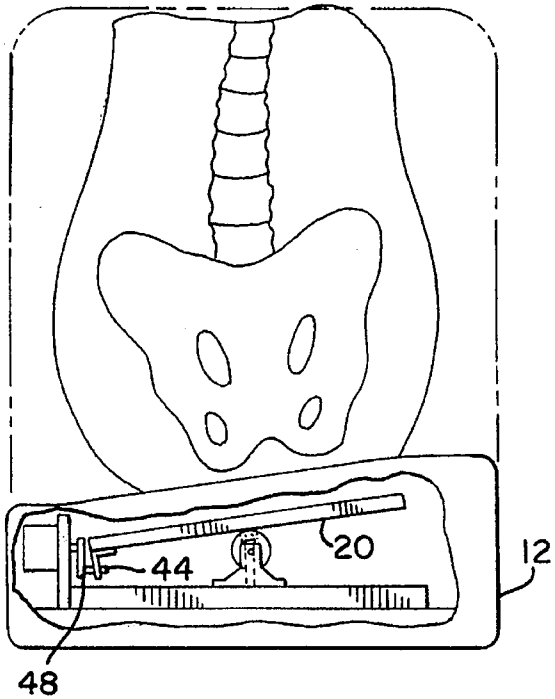
Figure 4A:
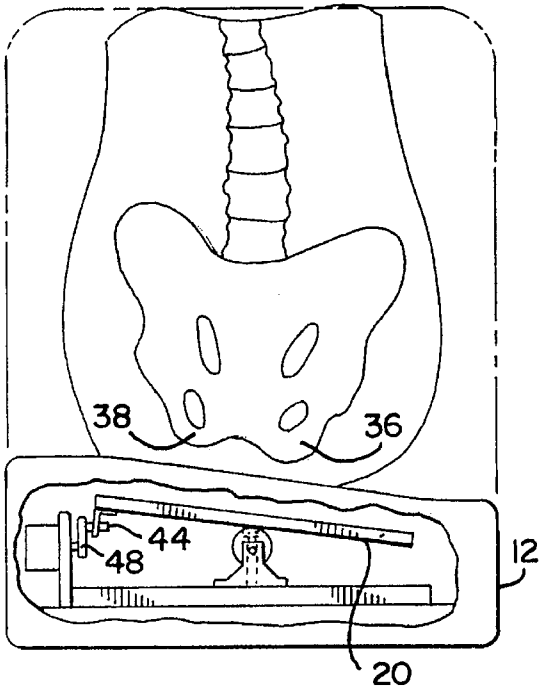

FIGS. 4*a-c* illustrate the lifting component of the top panel's wobble motion. In FIG. 4*c*, the crank arm 48 is in either its forward-most (toward F) or backward-most (toward B) position, and thus, the panel 20 is substantially parallel with the ground. In FIG. 4*b*, the crank arm 48 is in its lowest vertical position, and thus, the left side (L) of the top panel 20 is moved downward. At the same time, the right side (R) of the top panel 20 is now in a higher vertical position relative to the left side of the panel 20. Thus, the right hip of the user is raised relative to the left hip of the user. In FIG. 4*a*, the crank arm 48 is in its highest vertical position, and thus, the left side (L) of the panel 20 is raised above the level of the right side (R) of the panel 20. Thus, the left hip of the user is raised relative to the right hip of the user.

Figure 5A:
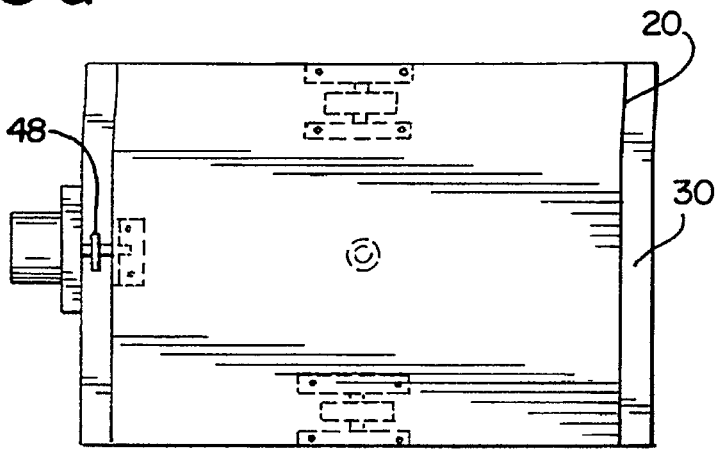
FIGS. 5*a*–5*c* illustrate a plan view of the seating device shown in FIG. 1.
Figure 5B:
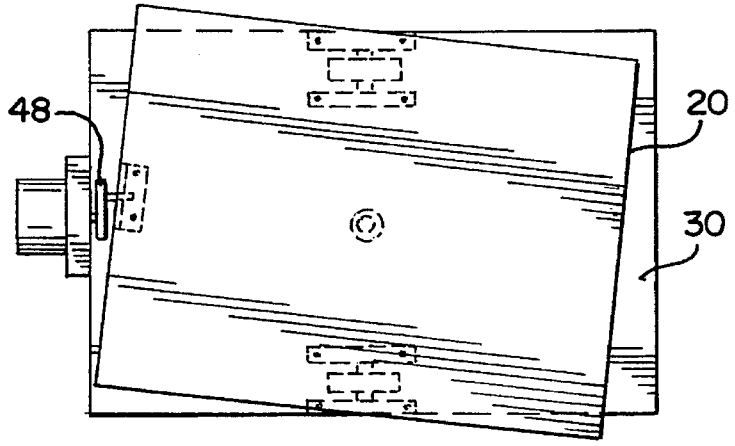
Figure 5C:
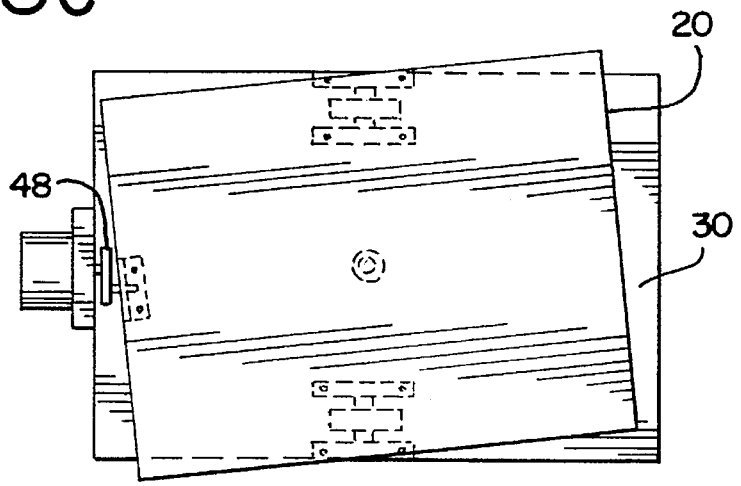

FIGS. 5*a-c* illustrate the rotational component of the top panel's wobble motion. For illustration purposes, the top panel 20 is shown as smaller than the bottom panel 30. In FIG. 5*a*, the crank arm 48 is at either its highest vertical position or its lowest vertical position. In FIG. 5*b*, the crank arm 48 is in its forward-most (toward F) position, and thus, the top panel 20 has rotated clockwise. In FIG. 5*c*, the crank arm 48 is in its backward-most (toward B) position, and thus, the top panel 20 has rotated counterclockwise.

A major advantage of the described wobble motion is that one hip is lifted while the other hip is lowered, and thus, no net lifting energy is required. This permits the use of a very small driving motor 40 (typically 4–8 watts). Other advantages include small size, simple and quiet operations and economical components.

The precise size of the seating device 10 may vary depending on the application. In general, the panel 20 should be at least wide enough to impact under the ischium bones 36, 38 of a seated person. The size of the crank arm 48 may be chosen such that the imparted motion imperceptible, or in the alternatives quite pronounced.

The above-described invention defines both a device and method for imparting a desired body motion to a seated person. The method involves the steps of periodically, rhythmically and continuously lifting and/or moving forward one hip of a seated person and then the other hip. Thereby, some of the blood circulation and muscle stimulation normally attained through walking can be attained while sitting. The antifatigue device and method of the present invention may be used in conjunction with any activity which involves sitting —particularly prolonged sitting. This would include driving an automobile or truck, working in an office, or operating machinery. An even greater benefit is derived in applications where the user is extremely sedentary such as when a person is confined to a wheelchair. Thus, a person does not have to walk to gain some of the benefits of walking.

While the above-described embodiment of the invention is preferred, those skilled in the art will recognize modifications of structure, arrangement, composition and the like which do not part from the true scope of the invention. The invention and its equivalents are intended to be covered by the appended claims.

I claim:

1. An ergonomic antifatigue device for moving the hips and lower midsection of a person seated in a seating apparatus, the device comprising:

a first support having a support element positioned under the hips of the seated person, said support element comprising a left side and a right side;

a central point located substantially within said support element;

a second support structure connected to said support element at said central point for maintaining said central point in a substantially non-moving position while allowing movement of all portions of said support element other than said central point; and a motor and coupling connected to said first support;

said motor and coupling automatically and alternately pivoting said left side of said support element up and down about said central point, and automatically and alternately pivoting said right side of said support element up and down about said central point, thereby automatically and alternately lifting one hip of the seated person and then the other hip;

said motor and coupling also automatically and alternately rotating said support element back and forth about said central point as a series of cyclical rotations and counter-rotations, thereby cyclically moving backward and forward the hips of the seated person;

whereby motion and stimulation are translated to the seated person in a similar fashion to the motion and stimulation imparted to a person through walking.

2. The device defined in claim 1 wherein said support element comprises a substantially planar surface.

3. The device defined in claim 1 wherein said support element at least partially follows the contour of a human buttocks.

4. The invention defined in claim 1 wherein said central point is adjacent to a pelvis of the seated person.

5. The invention defined in claim 1 wherein said second support comprises a stem, fixed at one end to a support panel, and movably attached at another end to said support element.

6. The invention defined in claim 5 wherein said stem is movably attached to said support element at said central point.

* * * * *